US005981005A

United States Patent [19]

Schiess

[11] Patent Number: 5,981,005

[45] Date of Patent: Nov. 9, 1999

[54] DECORATIVE ANIMALS

[76] Inventor: Robert C. Schiess, 186 W. 700 South, Wellsville, Utah 84339

[21] Appl. No.: 09/105,526

[22] Filed: Jun. 26, 1998

[51] Int. Cl.[6] ..... A63H 3/36

[52] U.S. Cl. ..... 428/16; 428/121; 446/385; 446/388; 446/488

[58] Field of Search ..... 428/121, 16; 446/385, 446/388, 488

[56] References Cited

U.S. PATENT DOCUMENTS 2,920,411 1/1960 Mitchell ..... 446/385

*Primary Examiner*—Alexander Thomas

*Attorney, Agent, or Firm*—Thompson E. Fehr

[57] ABSTRACT

A decorated animal having the trunk of said animal simulated by a piece of carpeting folded with the side containing the fibers on the outside of the folded carpet to simulate the trunk of an animal. One or more appendages are attached to the carpeting to represent heads, necks, arms, legs, and tails. And one or more additional appendages are connect to the appendages to simulate ears; manes; eyes; beaks; noses; and heads, when a neck has been attached to the carpet.

3 Claims, 1 Drawing Sheet

DECORATIVE ANIMALS

BACKGROUND OF THE INVENTION

1. Field of the Invention

This invention relates to decorative animals, the body of which is made with folded carpeting, and to the method for making such decorative animals.

2. Description of the Related Art

Although numerous patents exist for toy or decorative animals, the Inventor could locate no patents covering such animals wherein the body is made with folded carpeting.

SUMMARY OF THE INVENTION

The present invention is formed basically from carpeting.

A piece of carpeting is folded with the side containing the fibers on the outside of the folded carpet. The folded carpet simulates the trunk of the body of an animal.

Appendages simulating portions of the body of the animal, such as heads, necks, arms, and legs, are attached to the folded carpet.

Since the carpeting is attached to itself only along the portion of such carpeting that is at the greatest distance from the fold, the aperture created by folding the carpeting can, if desired, be utilized to store an article, such as an air freshener.

DESCRIPTION OF THE PREFERRED EMBODIMENT

Figure 1:
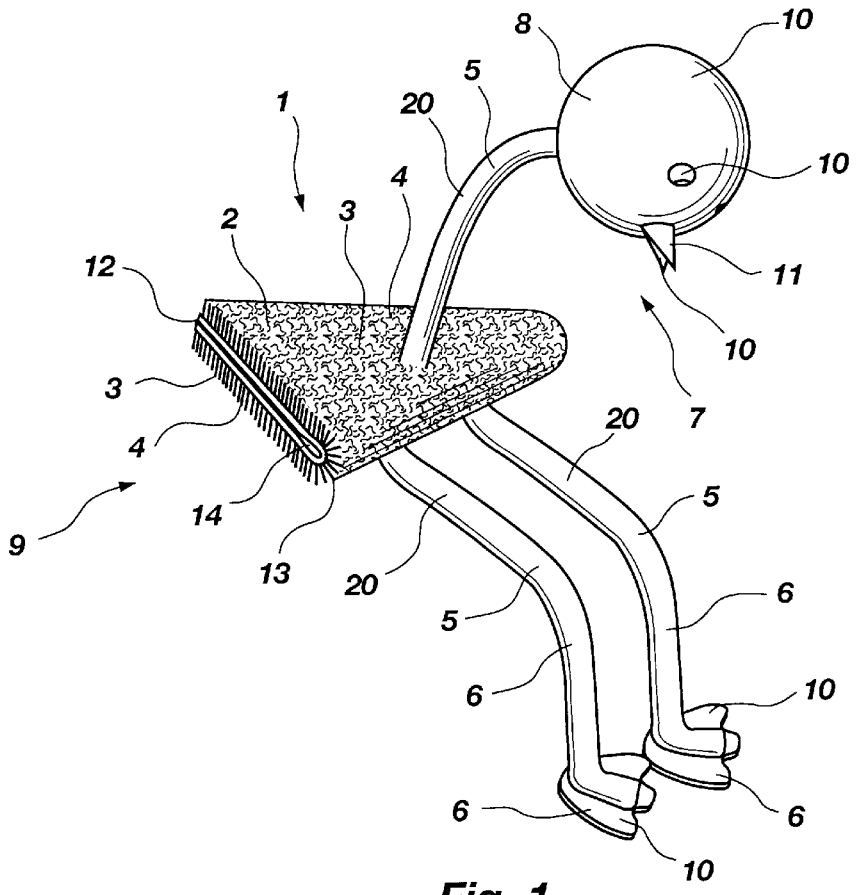
FIG. 1 depicts a Decorative Animal where the carpeting has been folded into a triangle.

A piece of carpeting 1 is folded with the side 2 containing the fibers 3 on the outside 4 of the folded carpet 1.

Figure 2:
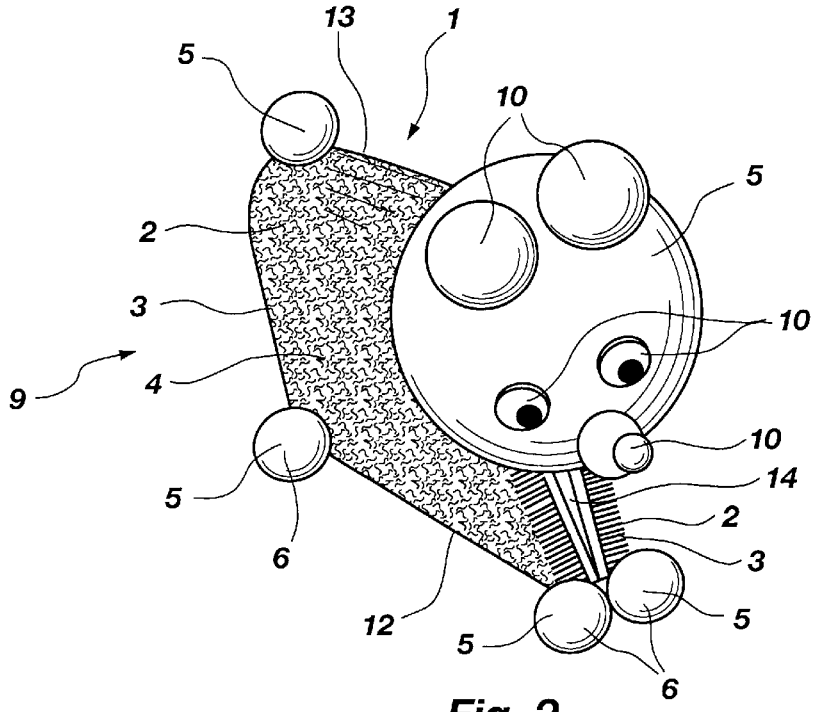
FIG. 2 shows a Decorative Animal where the carpeting has been folded into a rectangle.

Carpeting 1 folded into a triangle mimics the body and wings of a bird, as illustrated in FIG. 1. Carpeting 1 folded into a rectangle simulates the trunk of the body of a variety of other animals, as demonstrated in FIG. 2.

Appendages 5 simulating portions of the body of the animal, such as heads, necks, arms, legs, and tails are attached to the folded carpet 1.

Feet and legs 6 are generally formed from smaller pom poms. However, the feet 6 of a simulated ostrich 7 are, as depicted in FIG. 1, formed from flat felt connected by pipe cleaners 20 to the triangularly folded carpet 1. The head 8 of the ostrich 7 is also at the end of a pipe cleaner 20. The heads 8 of most animals 9, though, are attached directly to the carpet 1, as portrayed in FIG. 2 and are usually large pom poms.

Tails are simulated either by flat felt or pom poms. A twisted pipe cleaner, however, simulates the tail of a pig.

Additional appendages 10 represent body parts, such as ears, manes, eyes, beaks, whiskers, and noses (and heads when a neck has been attached to the carpet 1 as well as feet when legs have been attached to the carpet 1) which are attached to an appendage 5 or to another additional appendage 10, rather than to the folded carpet 1. Flat felt is used to simulate a lion's mane. Ears are simulated either by flat felt or pom poms. Noses are generally represented with small spheres. Beaks 11 are usually imitated with triangular flat felt. A commercially available clear disc containing a smaller black disc is generally used for the eyes of the animal. Whiskers are formed from monofilament fishing line.

When attached to an additional appendage 10, the attached additional appendage 10 is termed a further additional appendage 10. Exammples of further additional appendages 10 are ears, eyes, beaks, whiskers, and noses attached to a head 8 that is attached to a neck.

Since the carpeting 1 is attached to itself only along the portion 12 of such carpeting 1 that is at the greatest distance from the fold 13, the aperture 14 created by folding the carpeting 1 can, if desired, be utilized to store an article, such as an air freshener.

If desired, a string (not illustrated) can be attached to the carpet (preferably, by inserting the string through the carpet with a needle and then tying the ends of the string together) so that the Decorative Animal can be hung from the rear view mirror of a car.

All attachments other than that of the string to the carpet are preferably done by using a heated adhesive.

I claim:

1. A decorative animal, which comprises:

a piece of carpeting folded with the side containing the fibers on the outside of the folded carpet to simulate the trunk of an animal, wherein said piece of carpeting is attached to itself only along the portion of said piece of carpeting that is at the greatest distance from the fold; and an appendage attached to said carpeting to represent a body portion selected from the group consisting of heads, necks, arms, legs, and tails.

2. The decorative animal as recited in claim 1, further comprising:

an additional appendage attached to said appendage to represent a body portion selected from the group consisting of ears, manes, eyes, beaks, whiskers, feet, noses, and heads.

3. The decorative animal as recited in claim 2, further comprising:

a further additional appendage attached to said additional appendage to represent a body portion selected from the group consisting of ears, eyes, beaks, whiskers, and noses.

* * * * *